US005842545A

United States Patent [19]

Blaiotta

[11] Patent Number: 5,842,545

[45] Date of Patent: Dec. 1, 1998

[54] ELEVATOR CAB ASSEMBLY AND METHOD OF ASSEMBLING SAME

[75] Inventor: Louis J. Blaiotta, Port Chester, N.Y.

[73] Assignee: Columbia Elevator Products Co., Inc., Portchester, N.Y.

[21] Appl. No.: 625,620

[22] Filed: Mar. 29, 1996

[51] Int. Cl.[6] ..... B66B 11/02

[52] U.S. Cl. ..... 187/401; 57/588.1

[58] Field of Search ..... 187/401, 414; 52/578, 588.1

[56] References Cited

U.S. PATENT DOCUMENTS 4,699,251 10/1987 Orndorff et al. ..... 187/401
4,700,809 10/1987 Lazar ..... 187/401
5,207,295 5/1993 Bialy et al. ..... 187/1 R

FOREIGN PATENT DOCUMENTS 2591679 6/1987 France ..... 187/401

*Primary Examiner*—Kenneth Noland
*Attorney, Agent, or Firm*—Sprung Kramer Schaefer & Briscoe

[57] ABSTRACT

An elevator cab assembly and method of assembling same wherein a plurality of side panels are connected by interlocking longitudinal edges of the side panels with longitudinal edges of adjacent side wall panels without additional fasteners. The ceiling can also be assembled using interlocking ceiling panels without the need of additional fasteners.

22 Claims, 3 Drawing Sheets

ELEVATOR CAB ASSEMBLY AND METHOD OF ASSEMBLING SAME

BACKGROUND OF THE INVENTION

The present invention relates to elevator cabs, and in particular, to an elevator cab assembly and a method of assembling an elevator cab.

Conventional elevator cabs or cars comprise panels that are connected together to form the side walls and the ceiling. The assembly of these panels involves the use of fasteners, nuts, bolts, etc. and require a great deal of installation time for the assembly of the cab in the hazardous elevator shaftway, hoistway, runway environment.

SUMMARY OF THE INVENTION

The main object of the present invention is to eliminate the disadvantages of prior art elevator cab assemblies and methods of assembling an elevator cab.

Another object of the present invention is to provide an elevator cab assembly which comprises panels which form the side walls and which have interlocking longitudinal edges that enable the panels to be connected together without additional fasteners.

A further object of the present invention is to provide a ceiling for the elevator cab which comprises ceiling panels having longitudinal edges which interlock to connect the ceiling panels together without additional fasteners.

A still further object of the present invention is to provide a method for assembling an elevator cab wherein the side walls are assembled by interlocking the longitudinal edges of wall panels together without the need for additional fasteners.

Still another object of the present invention is to provide a method of assembling an elevator cab ceiling by providing a plurality of ceiling panels and interlocking the longitudinal edges thereof to connect the ceiling panels together without additional fasteners.

These and other objects and advantages of the present invention are achieved in accordance with the present invention by an elevator cab assembly comprising side walls and a ceiling connected to the side walls, wherein the side walls comprise a plurality of wall panels each having at least one longitudinal edge interlocking with a longitudinal edge of an adjacent wall panel to connect the wall panels together without additional fasteners. Each interlocking longitudinal edge has a flange with a C or G-shaped cross section and cutaway areas to define alternating locking members and slots. The locking members of a wall panel flange are insertable through slots of an adjacent wall panel flange to engage the locking numbers of the two wall panel flanges to connect the wall panels together. The flanges are preferably integral with the wall panel.

The ceiling preferably comprises a plurality of ceiling panels each having at least one longitudinal edge interlocking with a longitudinal edge of an adjacent ceiling panel to connect the ceiling panels together without additional fasteners.

Each interlocking longitudinal edge of the ceiling panels has a flange with a C or G-shaped cross section and cutaway areas that define alternating locking members and slots. As with the side wall panels, the locking members of the ceiling panel flange are insertable through slots of an adjacent ceiling panel flange to engage the locking members of the two ceiling panel flanges to connect the ceiling panels together. The flanges are preferably integral with the ceiling panel.

In a particularly advantageous commercial embodiment of the present invention, one intermediate ceiling panel comprises three separate sections including a middle section having one longitudinal edge with locking members and one longitudinal edge without locking members and thereby unengaged. The middle section is thereby pivotable upwardly about the longitudinal edge with the locking members to form an emergency exit.

In accordance with the present invention, these and other objects are achieved by a method of assembling an elevator cab comprises the steps of connecting a plurality of side wall panels each having at least one longitudinal edge by interlocking one longitudinal edge with a longitudinal edge on an adjacent wall panel without additional fasteners to form side walls and connecting a ceiling to the side walls.

The ceiling is preferably formed by connecting a plurality of ceiling panels, each having at least one longitudinal edge, by interlocking one longitudinal edge with a longitudinal edge of an adjacent ceiling panel without additional fasteners.

These and other features of the present invention will be described in more detail in the following detailed description of the invention taken with the attached drawings, wherein:

DETAILED DESCRIPTION OF THE INVENTION

Figure 1:
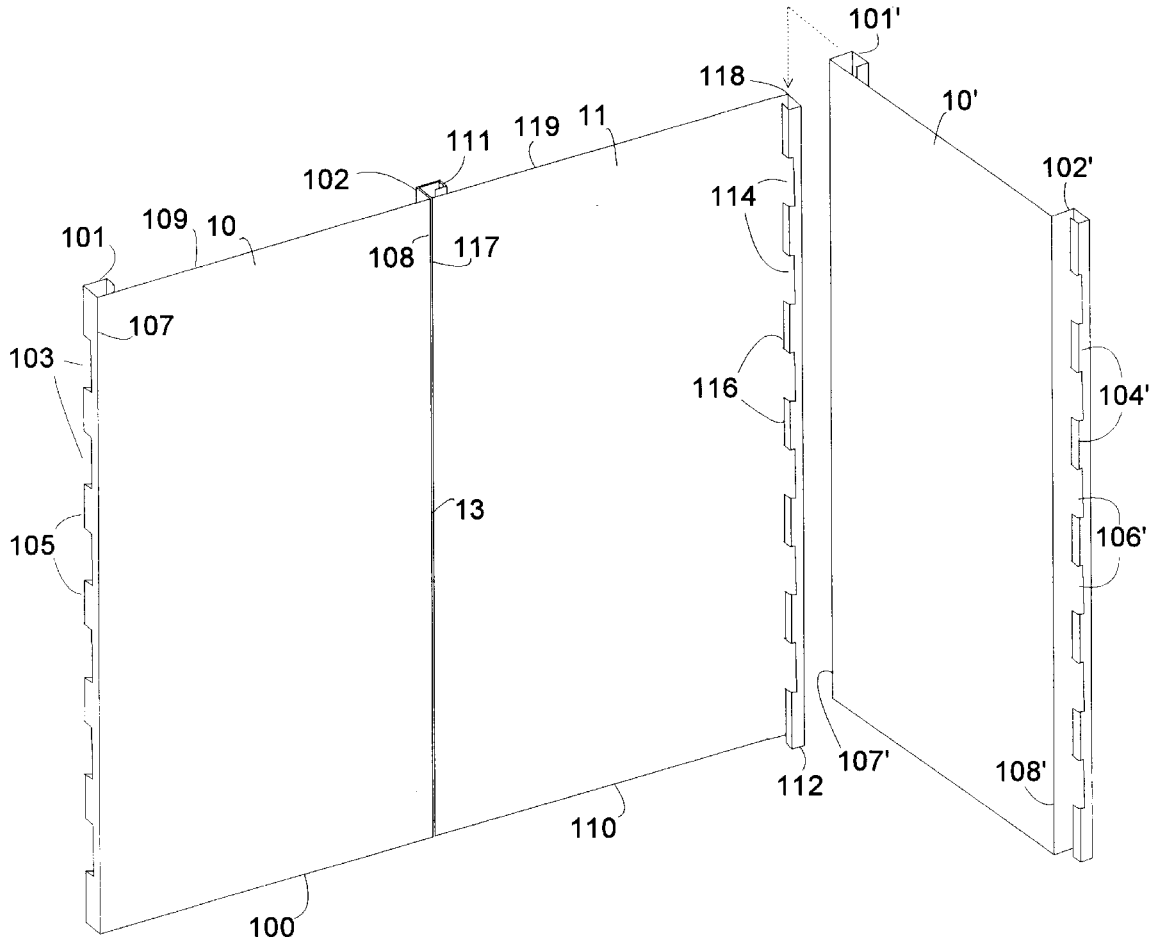
FIG. 1 is a perspective view of the elevator cab assembly side wall panels in accordance with the present invention.

Referring now to FIG. 1, a portion of an elevator cab assembly is shown comprising three side wall panels 10, 11 and 10'. The panels interlock at their longitudinal edges 108, 117, 118 and 107' with a longitudinal edge of an adjacent wall panel to connect the wall panels together without additional fasteners.

Wall panel 10 is a substantially planar panel having a bottom edge 100, a top edge 109, longitudinal edges 107 and 108 and flanges 101 and 102 connected to the longitudinal edges. Flange 101 has a right-angled C-shaped cross section, whereas flange 102 has a right-angled G-shaped cross section. Preferably, the flanges are integral with the panels 10. Flange 101 includes cutaway areas which define slots 103 and locking members 105. Flange 102 has similar slots and locking members 104 and 106 (not shown) although they are illustrated with regard to wall panel 10'.

Wall panel 10' is identical in construction to wall panel 10 and merely has each of the elements indicated with a prime to distinguish between the two panels.

Wall panel 11 has a slightly changed construction from wall panel 10 to allow for the right angle connection needed in a cab assembly and has upper and lower edges 110 and 119, longitudinal edges 117 and 118 and flanges 111 and 112. Flanges 111 and 112 have a right-angled C-shaped cross section. Flange 111 has slots and locking members 113 and 115 (not shown) and flange 112 has slots and locking members 114 and 116.

The panels are interconnected by inserting the locking members of one panel through the slots of the other by first raising one panel relative to the other by at least one slot length which is approximately 6" as shown in FIG. 1 with regard to panel 10' and panel 11, to allow for the insertion of the locking members into the slots and thereafter lowering panel 10' until the locking members of the two flanges are engaged. The panels can thereafter not be separated unless the panels can be lifted to insert the locking members into the slots. This is prevented by fastening panels 10, 11 and 10' to a platform, floor or base of the elevator cab (not shown). Moreover, a ceiling is connected to the side walls via fasteners. Thus, the panels are vertically fixed in place, thereby preventing the disassembly of the panels.

The connection of the locking members may involve some clearance or play. Relative movement in the horizontal direction is eliminated by inserting molding into the seam 13 formed between two wall panels.

The panels themselves are preferably constructed of steel or aluminum and can optionally have laminated plastic covering surface on the planar portion thereof to provide a decorative appearance for the inside of the elevator cab.

The panels are preferably 20 to 40 inches in width and approximately 7 to 10 feet in height and 1/16 to 1/8" in thickness.

Figure 2:
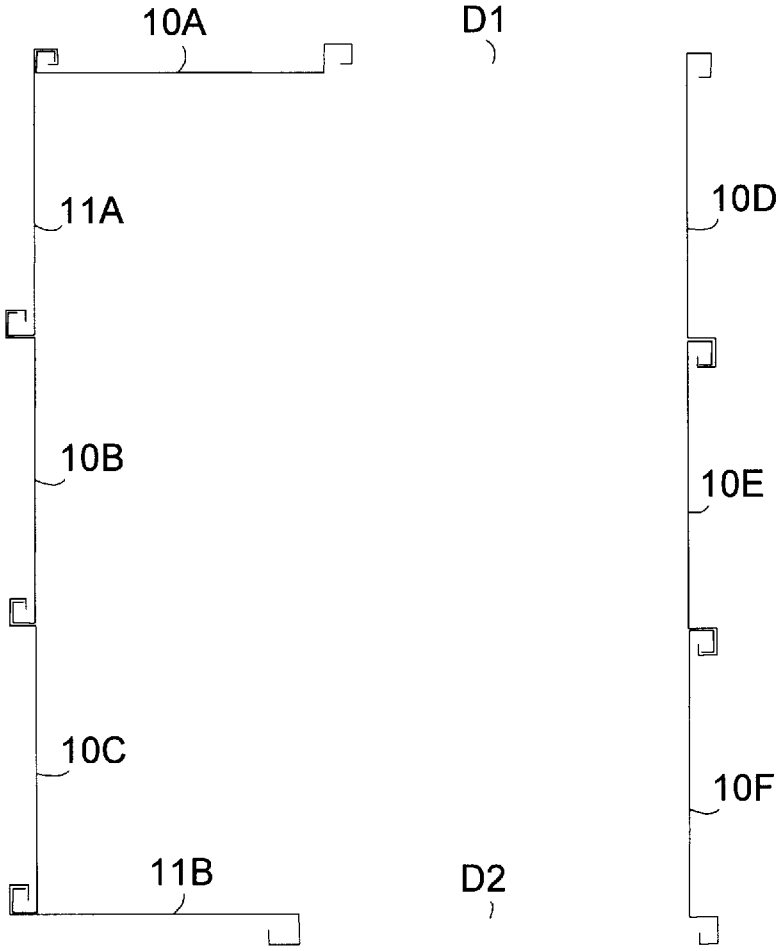
FIG. 2 is a top view of the interconnected side wall panels forming an elevator cab in accordance with the present invention.

FIG. 2 shows an example of how the panels are interconnected to form the walls of an elevator cab. The cab uses panel types 10 and 11 which are interconnected as shown. The construction uses six of the panels 10 which are numbered 10A–10F and two of the panels 11 which are numbered 11A–11B. The construction leaves two spaces D1 and D2 for door assemblies which are not shown but which interconnect with the flanges to provide the automatic opening and closing of the doors as is used in conventional elevator cabs.

Figure 3:
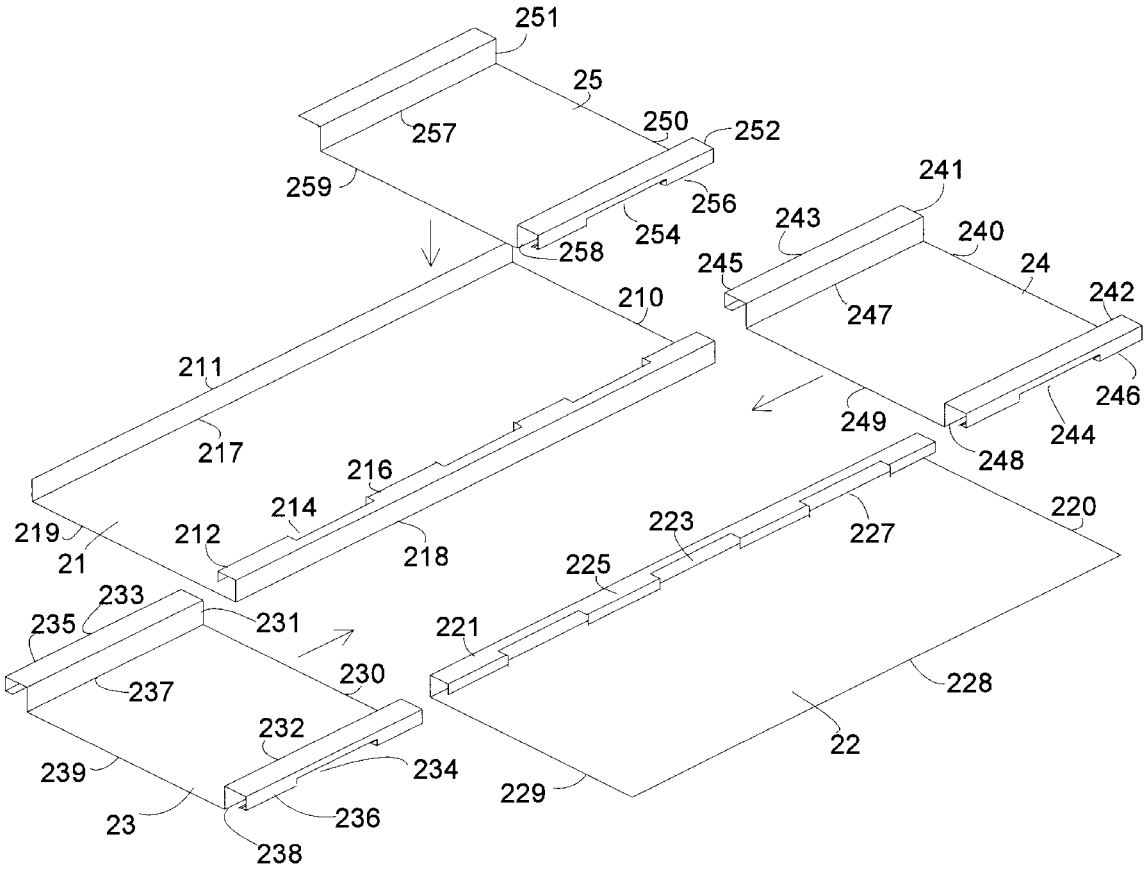
FIG. 3 is an exploded perspective view of the ceiling panels forming a ceiling of the elevator cab assembly according to the present invention.

While the elevator cab assembly according to the present invention can utilize a conventional ceiling which is fastened to the upper edges of the walls, in accordance with the present invention a particularly advantageous ceiling assembly can be obtained as shown in FIG. 3.

In the embodiment shown in FIG. 3, the ceiling includes ceiling sections 21–25.

Ceiling panel 21 includes a planar main section having edges 210 and 219 and longitudinal edges 217 and 218. Edge 217 has a non-interlocking flange 211 and edge 218 has flange 212 having a right-angled C-shaped cross section with cutout areas forming slots 214 and locking members 216.

Ceiling panel 22 has side edges 220 and 229 and longitudinal edges 228 and 227. Longitudinal edge 228 has no flange and longitudinal edge 227 has flange 221 which has a right-angled C-shaped cross section and which has cutaway areas forming slots 223 and locking members 225.

The intermediate panel between panels 21 and 22 is formed of three sections 23–25 including the outer sections 23 and 24 being virtually identical in construction. Panel 23 includes the planar section having edges 239 and 230 and longitudinal edges 237 and 238. Both longitudinal edges have right-angled G-shaped cross sections including locking members 235 and 236 and slots 233 and 234. Panel 24 has the planar section with edges 240 and 249, longitudinal edges 247 and 248 and right-angled G-shaped cross section flanges 241 and 242 with locking members 245 and 246 and slots 243 and 244.

Panel 25 includes edges 250 and 259, longitudinal edges 257 and 258 and flanges 251 and 252. Flange 251 is not an interlocking flange and has an L-shaped cross section. Flange 252 is an interlocking flange and has a right-angled G-shaped cross section with slot 258 and locking members 256.

The panels are interconnected by sliding panels 23 and 24 over the flanges 212 and 221 of panels 21 and 22 or by offsetting the panels by one slot length and inserting and locking by the same method as described for the wall panels. When edge 239 is aligned with edges 219 and 229 and edge 240 is aligned with edges 210 and 220, the panels are locked in place. Panel 25 is thereafter inserted by engaging the locking members 256 with locking members 225. Flange 251 then sits on flange 212 of panel 21.

As a result of the construction, the locking members 256 and 225 form a pinless hinge which allows the panel 25 to pivot therearound when pushed upwardly. As a result, panel 25 forms an emergency exit in the ceiling of the cab.

As with the side panels, the ceiling panels preferably are formed with the flanges integral with the planar panel portions thereof. The ceiling panels are preferably made of the same or similar materials to that of the wall panels and can have a laminated facing for decorative purposes.

The ceiling panels, after being assembled, are bolted to the tops of the side wall panels in a conventional manner.

It will be understood by those of skill in the art that the present invention can also be used for the assembly of permanent or temporary walls, floors, roofs, displays and partitions. In these embodiments, lighter weight metals and/or thinner materials, i.e., less than 1/16 to 1/8", may be used for the panels and alternatively, other materials such as high impact molded or extruded plastic can be used for the panels.

It is understood that the embodiments described hereinabove are merely illustrative and are not intended to limit the scope of the invention. It is realized that various changes, alterations, rearrangements and modifications can be made by those skilled in the art without substantially departing from the spirit and scope of the present invention.

What is claimed is:

1. An elevator cab assembly comprising: side walls and a ceiling connected to the side walls, wherein the side walls comprise a plurality of wall panels each having at least one longitudinal edge interlocking with a longitudinal edge of an adjacent wall panel to connect wall panels together without additional fasteners, wherein each interlocking longitudinal edge has a flange with cutaway areas defining a plurality of alternating locking members and slots and wherein the locking members of a wall panel flange are insertable through slots of an adjacent wall panel flange and longitudinally moveable relative thereto to engage the locking members of the two wall panel flanges to connect the wall panels together.

2. The elevator cab assembly according to claim 1, wherein the flange of each interlocking longitudinal edge has one of a C- and G-shaped cross section.

3. The elevator cab assembly according to claim 2, wherein the flanges are integral with the wall panel.

4. The elevator cab assembly according to claim 1, wherein the ceiling comprises a plurality of ceiling panels each having at least one longitudinal edge interlocking with a longitudinal edge of an adjacent ceiling panel to connect the ceiling panels together without additional fasteners.

5. The elevator cab assembly according to claim 4, wherein each interlocking longitudinal edge of the ceiling panels has a flange with one of a C- and G-shaped cross section and cutaway areas to define alternating locking members and slots and wherein the locking members of a ceiling panel flange are insertable through slots of an adjacent ceiling panel flange to engage the locking members of the two ceiling panel flanges to connect the ceiling panels together.

6. The elevator cab assembly according to claim 5, wherein the ceiling panel flanges are integral with the ceiling panel.

7. The elevator cab assembly according to claim 5, wherein one intermediate ceiling panel comprises three separate sections including a middle section having one longitudinal edge with locking members and one longitudinal edge without locking members and thereby unengaged, whereby the middle section is pivotable upwardly about the longitudinal edge with the locking members to form an emergency exit.

8. An elevator cab assembly comprising: side walls and a ceiling connected to the side walls, wherein the ceiling comprises a plurality of ceiling panels each having at least one longitudinal edge interlocking with a longitudinal edge of an adjacent ceiling panel to connect the ceiling panels together without additional fasteners, wherein each interlocking longitudinal edge has a flange with cutaway areas defining a plurality of alternating locking members and slots and wherein the locking members of a ceiling panel flange are insertable through slots of an adjacent ceiling panel flange and longitudinally moveable relative thereto to engage the locking members of the two ceiling wall panel flanges to connect the ceiling panels together.

9. The elevator cab assembly according to claim 8, wherein the flange of each interlocking longitudinal edge of the ceiling panels has one of a C- and G-shaped cross section.

10. The elevator cab assembly according to claim 9, wherein the flanges are integral with the ceiling panel.

11. The elevator cab assembly according to claim 9, wherein one intermediate ceiling panel comprises three separate sections including a middle section having one longitudinal edge with locking members and one longitudinal edge without locking members and thereby unengaged, whereby the middle section is pivotable upwardly about the longitudinal edge with the locking members to form an emergency exit.

12. A method of assembling an elevator cab comprising the steps of: connecting a plurality of side wall panels each having at least one longitudinal edge by interlocking one longitudinal edge with a longitudinal edge of an adjacent wall panel without additional fasteners to form side walls, wherein each interlocking longitudinal edge has a flange with cutaway areas defining a plurality of alternating locking members and slots and wherein the locking members of a wall panel flange are insertable through slots of an adjacent wall panel flange and longitudinally moveable relative thereto to engage the locking members of the two wall panel flanges to connect the wall panels together; and connecting a ceiling to the side walls.

13. The method according to claim 12, wherein the flange of each interlocking longitudinal has one of a C- and G-shaped cross section.

14. The method according to claim 13, wherein the flanges are integral with the wall panel.

15. The method according to claim 12, wherein the ceiling is formed by connecting a plurality of ceiling panels each having at least one longitudinal edge by interlocking one longitudinal edge with a longitudinal edge of an adjacent ceiling panel without additional fasteners.

16. The method according to claim 15, wherein each interlocking longitudinal edge of the ceiling panels has a flange with one of a C- and G-shaped cross section and cutaway areas to define alternating locking members and slots and wherein the step of interlocking comprises inserting locking members of a ceiling panel flange through slots of an adjacent ceiling panel flange to engage the locking members of the two ceiling panel flanges.

17. The method according to claim 16, wherein the flanges are integral with the ceiling panel.

18. The method according to claim 16, wherein one intermediate ceiling panel comprises three separate sections including a middle section having one longitudinal edge with locking members and one longitudinal edge without locking members and thereby unengaged, whereby the middle section is pivotable upwardly about the longitudinal edge with the locking members to form an emergency exit.

19. A method of assembling an elevator cab comprising the steps of: connecting a plurality of ceiling panels each having at least one longitudinal edge by interlocking one longitudinal edge with a longitudinal edge of an adjacent ceiling panel without additional fasteners to form a ceiling, wherein each interlocking longitudinal edge has a flange with cutaway areas defining a plurality of alternating locking members and slots and wherein the locking members of a ceiling panel flange are insertable through slots of an adjacent ceiling panel flange and longitudinally moveable relative thereto to engage the locking members of the two ceiling panel flanges to connect the ceiling panels together; and connecting the ceiling to side walls.

20. The method according to claim 19, wherein the flange of each interlocking longitudinal edge of the ceiling panels has one of a C- and G-shaped cross section.

21. The method according to claim 20, wherein the flanges are integral with the ceiling panel.

22. The method according to claim 21, wherein one intermediate ceiling panel comprises three separate sections including a middle section having one longitudinal edge with locking members and one longitudinal edge without locking members and thereby unengaged, whereby the middle section is pivotable upwardly about the longitudinal edge with the locking members to form an emergency exit.

* * * * *